US005613640A

United States Patent [19]

Furuya et al.

[11] Patent Number: 5,613,640

[45] Date of Patent: Mar. 25, 1997

[54] FUEL INJECTION VALVE

[75] Inventors: Yuji Furuya; Kenichi Iino; Hitoshi Okuyama, all of Saitama-ken, Japan

[73] Assignee: Zexel Corporation, Tokyo, Japan

[21] Appl. No.: 518,387

[22] Filed: Aug. 15, 1995

[30] Foreign Application Priority Data

Sep. 9, 1994 [JP] Japan ..... 6-241916

[51] Int. Cl.[6] ..... F02M 51/00

[52] U.S. Cl. ..... 239/585.5

[58] Field of Search ..... 239/585.1–585.5, 239/533.3–533.12; 251/129.18

[56] References Cited

U.S. PATENT DOCUMENTS

| | | | |
|---|---|---|---|
| 1,792,929 | 2/1931 | Remey | 239/585.5 X |
| 4,274,598 | 6/1981 | Wilfert et al. | 239/585.5 X |
| 5,088,647 | 2/1992 | Yoshida et al. | 239/585.3 X |
| 5,209,408 | 5/1993 | Reiter | 239/585.4 |
| 5,263,648 | 11/1993 | Vogt et al. . | |

FOREIGN PATENT DOCUMENTS

| | | | |
|---|---|---|---|
| 217248 | 9/1961 | Austria | 239/585.4 |
| 3120160 | 12/1982 | Germany | 239/585.4 |
| 2159211 | 11/1985 | United Kingdom | 239/585.3 |

*Primary Examiner*—Kevin Weldon

[57] ABSTRACT

A valve seat member is fixedly received in a lower end portion of an elongated body. The valve seat member has a valve seat and an injection port at its lower end portion. A valve element is axially movably received in the body. The valve element is fully lifted from a position where a valve portion formed on the lower end of the valve element sits on the valve seat to a position where an upper end portion of the valve element is brought into abutment with a stopper of the body. This fully lifted amount is determined by the thickness of a shim interposed between a first receiving surface of the body and a second receiving surface of the valve seat member. The lower end portion of the body and the valve seat member are welded over the entire periphery.

4 Claims, 2 Drawing Sheets

FUEL INJECTION VALVE

BACKGROUND OF THE INVENTION

This invention relates to a fuel injection valve in which a fully lifted amount of a valve element is adjustable.

In general, the fuel injection valve includes an elongated sleeve-like body and a valve seat member fixedly received in a lower end portion of the body. The valve seat member includes a guide hole extending axially, an injection port disposed at a lower end thereof, and a valve seat for intercommunicating the injection port and the guide hole. A needle-like valve element is slidably received in the guide hole of the valve seat member.

The valve element is lifted from a position where a valve portion formed on its lower end sits on the valve seat to a position where its upper end is brought into abutment with a stopper, so that fuel is injected from the injection port. The fully lifted amount of the valve element is one of the factors for determining an amount of injection of fuel.

Japanese Laid-Open Patent Application No. Hei 5-501748 (corresponding to U.S. Pat. No. 5,263,648 and EPC Pat. No. 497931B1) discloses a fuel injection valve in which the fully lifted amount of the valve element is adjustable. This fuel injection valve has a nozzle plate welded to a lower end face of a valve seat member. The nozzle plate has an opening formed in its central area and communicating with an injection port of the valve seat member. A peripheral edge portion of the nozzle plate is bent and formed into a sleeve-like configuration. This peripheral edge portion is welded to an inner peripheral surface of a lower end portion of a body. As a consequence, the valve seat member is not secured directly to the body but connected to the body through the nozzle plate.

In the fuel injection valve taught by the above publication, the position of the valve seat member is gradually finely adjusted upwardly relative to the body by finely deforming the nozzle plate with the use of a jig. By doing this, the fully lifted amount of the valve element is gradually finely changed. Each time the fine adjustment is made, fuel is injected and the amount of injection of the fuel is measured. When a desired amount of injection of fuel is obtained, the adjusting work is finished.

In the above-mentioned fuel injection valve, the fully lifted amount of the valve element can be adjusted with ease, simply by deforming the nozzle plate. Further, since the peripheral edge portion of the nozzle plate is welded to the inner peripheral surface of the body, there can be prevented the fuel from leaking from a gap between the body and the valve member and therefore, there is no need of a provision of a seal member such as an O-ring However, the above conventional fuel injection valve has the following shortcomings. A shock occurs to the valve element each time the valve element sits on the valve seat. Since the valve seat member is not secured directly to the body, this shock is applied to the nozzle plate. The nozzle plate is subjected to aging deformation by repeated shocks. Accordingly, the position of the valve seat member is gradually lowered relative to the body. As a consequence, the fully lifted amount of the valve element is increased, little by little, with the passage of time.

SUMMARY OF THE INVENTION

It is, therefore, an object of the present invention to provide a fuel injection valve in which fuel can be prevented from leaking through a gap formed between a body and a valve seat member without a need of a provision of a seal member, a fully lifted amount of a valve element can be adjusted with ease, and the fully lifted amount can be prevented from being varied with the passage of time.

According to the present invention, there is provided a fuel injection valve comprising:

(a) a body having a cylindrical configuration at least at a distal end portion thereof;

(b) a valve seat member received in the distal end portion of the body, the valve seat member having an injection port formed in a distal end thereof and a valve seat communicating with the injection port;

(c) a valve element received in the body for movement in an axial direction of the body, a valve portion facing with the valve seat being formed on a distal end of the valve element;

(d) a stopper disposed on the body, the valve element being fully lifted from a position where the valve portion sits on the valve seat to a position where a basal end portion of the valve element is brought into abutment with the stopper;

(e) annular shim means for adjusting the fully lifted amount of the valve element, the shim means being disposed in a space between a first annular receiving surface and a second annular receiving surface, the first receiving surface being formed on an inner periphery of the body and perpendicular to an axis of the body, the second receiving surface being formed on a part of the valve seat member which part is received in the body, the second receiving surface being perpendicular to the axis of the body; and (f) the distal end portion of the body and the valve seat member being welded over an entire periphery thereof.

DETAILED DESCRIPTION OF THE EMBODIMENT

Figure 1:
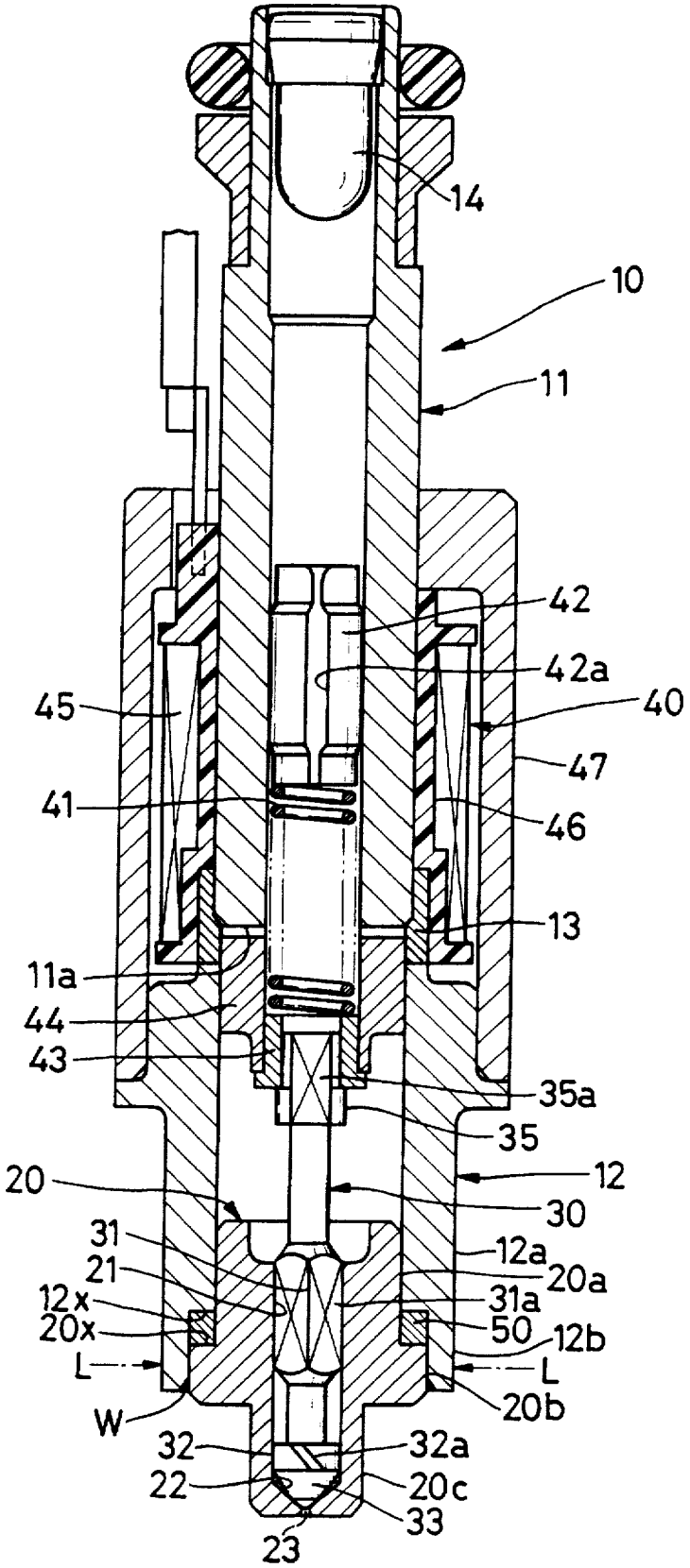
FIG. 1 is a vertical sectional view of a fuel injection valve according to one embodiment of the present invention.

One embodiment of the present invention will now be described with reference to FIG. 1. A fuel injection valve includes an elongated hollow body 10 which is to be attached to a cylinder head of an engine. The body 10 includes an upper sleeve 11 and a lower sleeve 12 coaxial with the upper sleeve 11. The lower sleeve 12 is larger in diameter than the upper sleeve 11. A connecting sleeve 13 is integral with an upper end of the lower sleeve 12. The connecting sleeve 13 is secured to an outer periphery of a lower end portion of the upper sleeve 11. A fuel (gasoline, for example) pressurized to a predetermined level is introduced from an open upper end of the upper sleeve 11 and supplied to the lower sleeve 12. A filter 14 is disposed at the upper end of the upper sleeve 11.

A valve seat member 20 coaxial with the lower sleeve 12 is fixedly received in a lower end portion of the lower sleeve 12. This fixing structure will be described later in detail. The valve seat member 20 has a hollow interior. The valve seat member 20 has a guide hole 21 extending in an axial direction of the valve seat member 20, an injection port 23 formed in a lower end portion of the valve seat member 20, and a valve seat 22 having a conical surface (tapered surface) formed between the guide hole 21 and the injection portion 23. The guide hole 21, valve seat 22 and injection port 23 are arranged on a center axis of the valve seat member 20.

A needle-like valve element 30 is inserted into the guide hole 21 of the valve seat member 20. The valve element 30 has a slide portion 31 formed on an intermediate portion thereof and another slide portion 32 formed on a lower end portion thereof. The slide portions 31 and 32 are slidably contacted with an inner peripheral surface of the guide hole 21.

A beveling 31*a* is formed on the upper slide portion 31. A gap formed between the beveling 31*a* and the inner peripheral surface of the guide hole 21 permits the passage of fuel. The lower slide portion 32 has a cylindrical configuration. A plurality of helical inclined grooves 32*a* are formed in an outer peripheral surface of the slide portion 32 at equal spaces in a circumferential direction thereof. The inclined grooves 32*a* permit the passage of fuel and provides a rotational motion to the flow of fuel.

A valve portion 33 is formed on the valve element 30. The valve portion 33 is integral with a lower end of the slide portion 32. The valve element 30 is moved downwardly to cause the valve portion 33 to sit on the valve seat 22, thereby closing the injection port 23. the valve element 30 is moved upwardly to cause the valve portion 33 to lift from the valve seat 22, thereby opening the injection port 23.

The valve element 30 is controlled by an electromagnetic drive means 40. This electromagnetic drive means 40 has a compression coil spring 41 for biasing the valve element 30 downwardly. An upper portion of the coil spring 41 is received in the upper sleeve 11. An upper end of the coil spring 41 is in abutment with a spring retainer 42 which is secured to the upper sleeve 11. The spring retainer 42 has a sleeve-like configuration and is provided with a slit 42*a* extending axially. Thus, the spring retainer 42 exhibits a C-shape in section. The spring retainer 42 is press-fitted in the upper sleeve 11. A head portion 35 is formed on an upper end of the valve element 30. A sleeve-like spring retainer 43 is secured to the head portion 35. A lower end of the coil spring 41 is in abutment with the spring retainer 43. In order to permit the passage of fuel, a beveling 35*a* is formed on the head portion 35.

The electromagnetic drive means 40 further includes a sleeve-like armature 44 secured to the spring retainer 43, an solenoid 45 attached to a lower portion of the upper sleeve 11 through a resin collar 46, and a cover 47 for covering the solenoid 45. The armature 44 is slidably received in the lower sleeve 12. A lower portion of the coil spring 41 is received in the armature 44. The connecting sleeve 13 is formed of a non-magnetic material such as SUS or the like. The upper sleeve 11, the lower sleeve 12, the armature 44 and the cover 47 are formed of a magnetic material.

With the above-mentioned construction, when a current is supplied to the solenoid 45, the armature 44 is moved upwardly against the coil spring 41 by a magnetic force generated to the solenoid 45. In response to the upward movement of the armature 44, the valve element 30 secured to the armature 44 is moved upwardly. As a consequence, the valve portion 33 of valve element 30 is lifted from the valve seat 22, and the injection port 23 is opened. As a consequence, the fuel of the predetermined pressure level introduced through the upper sleeve 11, armature 44, spring retainer 43 and lower sleeve 12 passes through the guide hole 21 of the valve seat member 20 and the inclined grooves 32*a* of the valve element 30. The fuel becomes a swirling current when it passes through the inclined grooves 32*a*, flows through a gap between the valve seat 22 and the valve portion 33 of the valve element 30 while swirling, and is injected, in a divergent fashion, into a combustion chamber of the engine from the injection port 23.

When the supply of current to the solenoid 45 is stopped, the valve element 30 is moved downwardly by the coil spring 41 and the valve portion 33 is caused to sit on the valve seat 22. Thus, the fuel injection from the injection port 23 is finished.

A lower end face 11*a* of the upper sleeve 11 is provided as a stopper. The valve element 30 is lifted from a position where the valve portion 33 sits on the valve seat 22 to a position where the armature 44 (the upper end portion of the valve element 30) is brought into abutment with the lower end face 11*a* of the upper sleeve 11. This amount for the valve element 30 to be lifted is referred to as the "fully lifted amount" of the valve portion 33.

Next, the characteristic part of the present invention will be described in detail. The lower sleeve 12 of the body 10 has a first cylindrical portion 12*a* at its intermediate portion and a second cylindrical portion 12*b* at its lower end portion. The second cylindrical portion 12*b* is equal in outer diameter to the first cylindrical portion 12*a*, larger in inner diameter than the first cylindrical portion 12*a*, and smaller in wall thickness than the first cylindrical portion 12*a*. An annular receiving surface 12*x* is formed on an inner periphery of the lower sleeve 12 at the boundary between the first cylindrical portion 12*a* and the second cylindrical portion 12*b*. This receiving surface 12*x* is perpendicular to the axis of the body 10.

On the other hand, the valve seat member 20 has a first insert portion 20*a* and a second insert portion 20*b* arranged in this order from the top. Further, the valve seat member 20 has a projected-portion 20*c* formed on a lower end face of the second insert portion 20*b*. The insert portions 20*a* and 20*b* and projected-portion 20*c* are coaxial with each other and each has a cylindrical outer peripheral surface. The above-mentioned valve seat 22 and injection port 23 are formed on the projected-portion 20*c*. The outer diameter of the first insert portion 20*a* is substantially equal to the inner diameter of the first cylindrical portion 12*a*. The first insert portion 20*a* is fitted into the first cylindrical portion 12*a*. The outer diameter of the second insert portion 20*b* is substantially equal to the inner diameter of the second cylindrical portion 12*b* of the lower sleeve 12. The second insert portion 20*b* is fitted into the second cylindrical portion 12*b*. A receiving surface 20*x* is formed on an outer periphery of the valve seat member 20 at the boundary between the first insert portion 20*a* and the second insert portion 20*b*. The receiving surface 20*x* is perpendicular to the axes of the valve seat member 20 and the body 10.

An annular shim 50 is interposed between the receiving surface 12*x* of the lower sleeve 12 and the receiving surface 20*x* of the valve seat member 20. The thickness of the shim 50 is served to determine the position of the valve seat member 20 with respect to the body 10 and then the position of the valve seat 22 of the valve seat member 20 with respect to the stopper 11*a* of the body 10. Eventually the thickness of the shim 50 is served to determine the fully lifted amount of the valve element 30. Accordingly, by varying the thickness of the shim 50, the fully lifted amount of the valve element 30 can be adjusted with ease.

Adjustment of the fully lifted amount of the valve element 30 is made in the following manner. With the valve seat member 20 received in the lower end portion of the body 10 as mentioned and with the shim 50 interposed between the receiving surfaces 12*x* and 20*x*, the valve seat member 20 is held on the body 10 by holding means not shown. In that state, the electromagnetic drive means 40 is driven to cause the valve element 30 to be lifted so that the fuel is injected. In the case where the amount of injection of the fuel is different from a desired amount, the valve seat member 20 is once removed from the body 10 and the shim 50 in use is replaced by another shim 50. That is, when the amount of injection of the fuel is smaller than the desired amount, the shim 50 in use is replaced by another shim 50 having a larger thickness. By doing this, the fully lifted amount of the valve element 30 can be increased. In contrast, when the amount of injection of the fuel is larger than the desired amount, the shim 50 in use is replaced by another shim 50 having a smaller thickness. By doing this, the fully lifted amount of the valve element 30 can be decreased. When the amount of injection of the fuel is adjusted to be the desired amount, the valve seat member 20 is fixedly welded to the lower sleeve 12 of the body 10 over the entire periphery of the lower sleeve 12. For example, the outer periphery of the second insert portion 20*b* of the valve seat member 20 is welded to a lower end of the second cylindrical portion 12*b* of the lower sleeve 12. This welding area is denoted by reference character W in FIG. 1. It should be noted that the outer periphery of the second insert portion 20*b* of the valve seat member 20 may be laser-welded to a peripheral wall of the second cylindrical portion 12*b* over the entire periphery thereof. A laser irradiating direction is denoted by reference character L in the illustration.

Since the valve seat member 20 is fixedly welded directly to the body 10 as mentioned above, a shock, if any, to the valve seat member 20 when the valve element 30 sits on the valve seat 22 does not change the position of the valve seat member 20 relative to the body 10. Thus, it can be prevented that the fully lifted amount of the valve element 30 is varied with the passage of time.

Further, there is no need of a provision of a member for securing the valve seat member 20 to the body 10. There is no need of a provision of an O-ring for preventing leakage of fuel from a gap between the valve seat member 20 and the body 10, either. Thus, the cost for manufacturing can be reduced.

Figure 2:
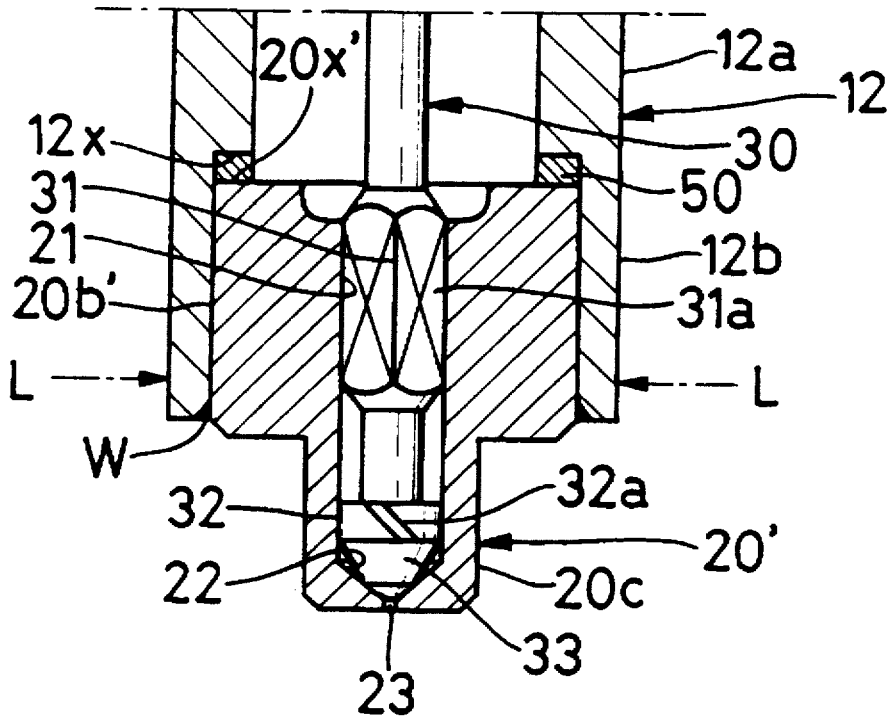
FIG. 2 is a vertical sectional view of an important portion of a fuel injection valve according to a modified embodiment of the present invention.

FIG. 2 shows another embodiment of the present invention. In this embodiment, component parts corresponding to those of the first-mentioned embodiment are denoted by like reference numerals and description thereof is omitted. An upper end face of an insert portion 20*b*' of a valve seat member 20' is served as a receiving surface 20*x* '. The shim 50 is interposed between the receiving surface 20*x* ' and the receiving surface 12*x* of the lower sleeve 12 of the body 10. The outer diameter of the insert portion 20*b*' is substantially equal to the inner diameter of the second cylindrical portion 12*b* of the lower sleeve 12. The insert portion 20*b* is fitted into the second cylindrical portion 12*b*.

The present invention is not limited to the above embodiments and many modifications can be made. For example, the shim means interposed between the receiving surface of the body and the receiving surface of the valve seat member is comprised of a single shim in the above embodiments but it may be comprised of a plurality of shims superimposed on upon another. In the case where the shim means is comprised of a plurality of shims, the thickness of the shim means can be adjusted by varying the thickness of one of the shims, or the thickness of the shim means can be adjusted by omitting a part of the shims or employing additional shims.

The fuel injection valve may be of the type in which the fuel injection valve is disposed on an intake manifold or of the type in which the fuel injection valve is disposed on a cylinder head of an engine and a valve element is lifted by receiving a high pressure fuel.

What is claimed is:

1. A fuel injection valve comprising:

(a) a body having a cylindrical configuration at least at a distal end portion thereof;

(b) a valve seat member received in the distal end portion of said body, said valve seat member having an injection port formed in a distal end thereof and a valve seat communicating with said injection port;

(c) a valve element received in said body for movement in an axial direction of said body, a valve portion facing with said valve seat being formed on a distal end of said valve element;

(d) a stopper disposed on said body, said valve element being fully lifted from a position where said valve portion sits on said valve seat to a position where a basal end portion of said valve element is brought into abutment with said stopper;

(e) annular shim means for adjusting the fully lifted amount of said valve element, said shim means being disposed in a space between a first annular receiving surface and a second annular receiving surface, said first receiving surface being formed on an inner periphery of said body and perpendicular to an axis of said body, said second receiving surface being formed on a part of said valve seat member which part is received in said body, said second receiving surface being perpendicular to the axis of said body, wherein said shim means is disposed inside of the body; and (f) the distal end portion of said body and said valve seat member being welded over an entire periphery thereof.

2. A fuel injection valve according to claim 1, in which said body has a first cylindrical portion and a second cylindrical portion disposed forwardly of said first cylindrical portion and an inner diameter of said second cylindrical portion is larger than that of said first cylindrical portion, said first receiving surface being formed on the inner periphery of said body at a boundary between said first cylindrical portion and said second cylindrical portion.

3. A fuel injection valve comprising:

(a) a body having a first cylindrical portion and a second cylindrical portion at a distal end portion thereof, the second cylindrical portion being disposed forwardly of the first cylindrical portion, an inner diameter of the second cylindrical portion being larger than that of the first cylindrical portion, a first annular receiving surface being formed on an inner periphery of the body at a boundary between the first cylindrical portion and the second cylindrical portion, the first receiving surface being perpendicular to an axis of the body;

(b) valve seat member received in the distal end portion of the body, said valve seat member having an injection port formed in a distal end thereof and a valve seat communicating with said injection port, said valve seat member including a first insert portion and a second insert portion disposed forwardly of said first insert portion, an outer diameter of said first insert portion being substantially equal to the inner diameter of said first cylindrical portion, said first insert portion being fitted into said first cylindrical portion, an outer diameter of said second insert portion being substantially equal to the inner diameter of said second cylindrical portion, said second insert portion being fitted into said second cylindrical portion, a second receiving surface being formed on an outer periphery of said valve seat member at a boundary between said first insert portion and said second insert portion, said second receiving surface being perpendicular to the axis of said body;

(c) a valve element received in the body for movement in an axial direction of the body, a valve portion facing with said valve the being formed on a distal end of the valve element;

(d) a stopper disposed on the body, said valve element being fully lifted from a position where the valve portion sits on the valve seat to a position where a basal end portion of the valve element is brought into abutment with the stopper;

(e) annular shim means for adjusting the fully lifted amount of the valve element, said shim means being interposed between said first and second receiving surfaces; and (f) said second cylindrical portion of the body and said second insert portion of the valve seat member being welded over an entire periphery thereof.

4. A fuel injection valve, comprising:

(a) a body having a first cylindrical portion and a second cylindrical portion at a distal end portion thereof, the second cylindrical portion being disposed forwardly of the first cylindrical portion, an inner diameter of the second cylindrical portion being larger than that of the first cylindrical portion, a first annular receiving surface being formed on an inner periphery of the body at a boundary between the first cylindrical portion and the second cylindrical portion, wherein said first annular receiving surface being perpendicular to an axis of the body;

(b) a valve seat member received in the distal end portion of the body, said valve seat member having an injection port formed in a distal end thereof and a valve seat communicating with said injection port, said valve seat member having an insert portion, an outer diameter of said insert portion being substantially equal to the inner diameter of said second cylindrical portion, said insert portion being fitted into said second cylindrical portion, a second receiving surface being formed on a basal end surface of said insert portion, said second receiving surface being perpendicular to the axis of said body;

(c) a valve element received in the body for movement in an axial direction of the body, a valve portion facing with the valve seat being formed on a distal end of the valve element;

(d) a stopper disposed on the body, the valve element being fully lifted from a position where the valve portion sits on the valve seat to a position where a basal end portion of the valve element is brought into abutment with the stopper;

(e) annular shim means for adjusting the fully lifted amount of the valve element, said shim means being interposed between the first and second receiving surfaces; and (f) the second cylindrical portion of the body and the insert portion of the valve seat member being welded over an entire periphery thereof.

* * * * *

UNITED STATES PATENT AND TRADEMARK OFFICE

CERTIFICATE OF CORRECTION

PATENT NO. : 5,613,640

DATED : March 25, 1997

INVENTOR(S) : Yuji FURUYA et al.

It is hereby certified that errs appear in the above-identified patent and that said Letters Patent is hereby corrected as shown below:

Column 7:

Claim 3, line 9, change "said valve the" to --said valve seat--.

Signed and Sealed this

Ninth Day of September, 1997

*Attest:*

BRUCE LEHMAN

*Attesting Officer*

*Commissioner of Patents and Trademarks*